US011993296B2

(12) United States Patent
Rodet

(10) Patent No.: US 11,993,296 B2
(45) Date of Patent: May 28, 2024

(54) RAILWAY VEHICLE BOGIE AND ASSOCIATED RAILWAY VEHICLE AND MACHINING PROCESS

(71) Applicant: ALSTOM Transport Technologies, Saint-Ouen-sur-Seine (FR)

(72) Inventor: Alain Rodet, Chalon sur Saone (FR)

(73) Assignee: ALSTOM Transport Technologies, Saint-Ouen-sur-Seine (FR)

( * ) Notice: Subject to any disclaimer, the term of this patent is extended or adjusted under 35 U.S.C. 154(b) by 384 days.

(21) Appl. No.: 17/454,660

(22) Filed: Nov. 12, 2021

(65) Prior Publication Data

US 2022/0153321 A1 May 19, 2022

(30) Foreign Application Priority Data

Nov. 13, 2020 (FR) ..... 20 11650

(51) Int. Cl.

| | |
|---|---|
| ***B61F 5/26*** | (2006.01) |
| ***B61F 3/00*** | (2006.01) |
| ***B61F 3/16*** | (2006.01) |
| ***B61F 5/30*** | (2006.01) |
| ***B61F 5/32*** | (2006.01) |

(Continued)

(52) U.S. Cl.

CPC ..... *B61F 5/26* (2013.01); *B61F 3/00* (2013.01); *B61F 3/16* (2013.01); *B61F 5/302* (2013.01); *B61F 5/325* (2013.01); *B61F 5/52* (2013.01); *B61F 15/00* (2013.01)

(58) Field of Classification Search

CPC ..... B61F 5/52; B61F 3/04; B61F 5/30; B61F 5/302; B61F 3/16; B61F 5/50; B61F 5/26; B61F 5/28

See application file for complete search history.

(56) References Cited

U.S. PATENT DOCUMENTS 5,730,064 A * 3/1998 Bishop ..... B61F 3/16 105/169
9,242,657 B2 * 1/2016 Nishimura ..... B61F 5/30

(Continued)

FOREIGN PATENT DOCUMENTS

CN 104709293 B * 1/2019 ..... B61C 9/44
EP 2258596 A1 * 12/2010 ..... B61C 9/44
EP 2258596 A1 12/2010

(Continued)

OTHER PUBLICATIONS

French Search Report issued for French Patent Application No. FR 2011650, dated Jul. 27, 2021 in 2 pages.

*Primary Examiner* — Zachary L Kuhfuss
*Assistant Examiner* — Cheng Lin
(74) *Attorney, Agent, or Firm* — Knobbe, Martens, Olson & Bear, LLP

(57) ABSTRACT

A bogie is capable of being moved from a rest configuration to an active configuration in which the bogie carries at least one vertical load. The bogie includes a chassis, at least one pair of wheels, and a shaft extending along an axle axis for each pair of wheels. Each wheel has a wheel hub extending along a hub axis and an axle box attached to the chassis and receiving the associated hub. Each hub is rotatable relative to the associated axle box. For each hub, the hub axis forms a non-zero camber angle with the axle axis of the associated shaft when the bogie is in the rest configuration.

10 Claims, 3 Drawing Sheets

(51) Int. Cl.
*B61F 5/52* (2006.01)
*B61F 15/00* (2006.01)

(56) References Cited

U.S. PATENT DOCUMENTS

| | | | | |
|---|---|---|---|---|
| 9,902,407 | B2 * | 2/2018 | Sato | F16D 3/223 |
| 2007/0169663 | A1 * | 7/2007 | Berg | B61F 5/26<br>105/206.1 |

FOREIGN PATENT DOCUMENTS

| | | | | |
|---|---|---|---|---|
| EP | 3222483 | A1 | 9/2017 | |
| EP | 3650304 | A1 | 5/2020 | |
| FR | 3049252 | A1 * | 9/2017 | |
| FR | 3049252 | A1 | 9/2017 | |
| WO | WO-2015004998 | A1 * | 1/2015 | B61F 3/16 |

* cited by examiner

RAILWAY VEHICLE BOGIE AND ASSOCIATED RAILWAY VEHICLE AND MACHINING PROCESS

CROSS-REFERENCE TO RELATED APPLICATIONS

This application is a U.S. non-provisional application claiming the benefit of French Application No. 20 11650, filed on Nov. 13, 2020, which is incorporated herein by reference in its entirety.

FIELD OF THE INVENTION

The present invention relates to a railway vehicle bogie.

The present invention also relates to a railway vehicle equipped with such a bogie.

The present invention also relates to a method for machining such a bogie.

BACKGROUND

It is known to arrange a bogie under the cars of a railway vehicle in order to support the cars and to guide them when the railway vehicle moves along the rails.

Conventionally, a bogie comprises a chassis and axles, each axle comprising two coaxial wheels rotatably mounted on the chassis.

However, the bogie is at risk of premature wear and tear due to various misalignments of the bogie parts under the load of the car.

SUMMARY

One of the aims of the invention is therefore to offer a bogie with less risk of premature wear and tear and thus reduce the need for maintenance on the bogie.

To this end, the invention has as its object a railway vehicle bogie capable of moving from a rest configuration to an active configuration in which the bogie supports at least one vertical load, comprising a chassis; at least one pair of wheels; for each pair of wheels, a shaft connecting the two wheels of said pair of wheels, each shaft extending along an axle axis; for each wheel, a wheel hub attached to the wheel and the associated shaft, said shaft being inserted into the hub, each hub extending along a hub axis; for each wheel, an axle box attached to the chassis and receiving the associated hub, each hub being rotatable relative to the associated axle box; for each hub, the hub axis forms a non-zero camber angle with the axle axis of the associated shaft when the bogie is in the rest configuration.

In particular embodiments, the bogie comprises one or more of the following optional features:

- the camber angle when the bogie is in the rest configuration is predetermined at least as a function of the stiffness of the chassis and the vertical load supported by the bogie in the active configuration;
- the chassis comprises, for each shaft, at least one transverse beam connecting the two associated axle boxes to form the axle; and
- each shaft is connected to each associated hub by a splined connection.

The invention further relates to a railway vehicle comprising at least one bogie as defined above.

The invention further relates to a method of machining a bogie as defined above, the bogie being initially in the rest configuration, the method comprising at least the following steps:

- prestressing the transverse beam by applying a vertical load to the chassis,
- machining each axle box so as to receive the associated hub, the machining being carried out so that the hub axis of said hub is substantially parallel to the axle axis of the associated shaft.

In particular embodiments, the machining method comprises one or more of the following optional features:

the prestressing of the transverse beam is greater than an equivalent load of 5,000 kg, in particular greater than 8,000 kg, the bogie being initially in the rest configuration, the method comprising at least one step of machining each axle box so as to receive the associated hub, the machining being carried out so that the hub axis of said hub forms the non-zero camber angle.

BRIEF DESCRIPTION OF THE DRAWINGS

Further features and advantages of the invention will be apparent from the detailed description given below, by way of indication and not in any way limiting, with reference to the appended figures, among which.

DETAILED DESCRIPTION

The terms "vertical", "horizontal", "transverse" and "longitudinal" are generally understood to refer to the usual directions of a railway vehicle travelling on horizontal rails.

Figure 1:
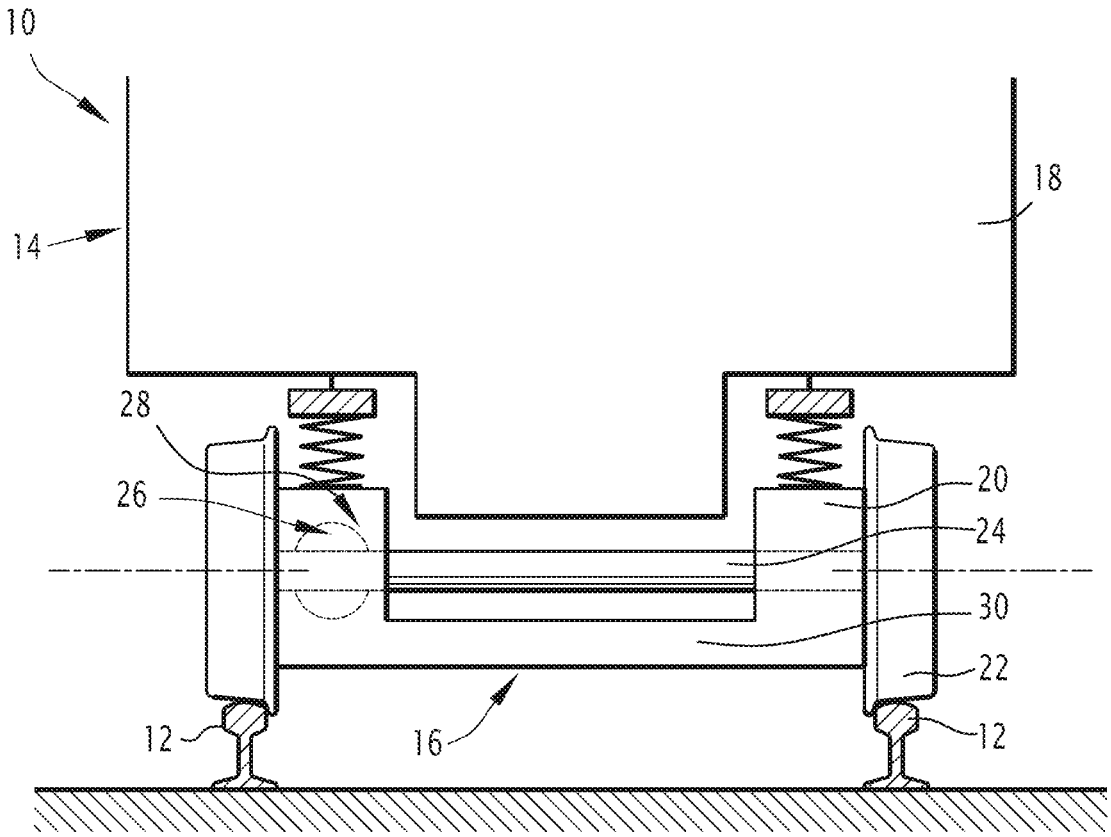
FIG. 1 is a cross-sectional schematic view of a railway vehicle according to the invention.

FIG. 1 shows a railway vehicle 10 running on longitudinally extending rails 12.

The railway vehicle 10 comprises at least one car 14 and at least one bogie 16.

Each car 14 has an interior volume 18 configured to accommodate passengers and/or goods to be transported.

The bogie 16 is arranged, for example, at one end of the car 14 and supports two adjacent cars 14 when the railway vehicle 10 comprises multiple cars 14. In a conventional embodiment, the or each car 14 is supported by two bogies 16, one at each end.

The bogie 16 is capable of switching from a rest configuration to an active configuration.

In the rest configuration, the bogie 16 is away from the cars 14 and therefore does not carry a vertical load.

In particular, the bogie 16 is in the rest configuration prior to the assembly of the railway vehicle 10 during its manufacture.

In the active configuration, shown in FIG. 1, the bogie 16 supports a vertical load due to the at least one supported car 14 and the passengers and/or goods carried by each car 14 supported by the bogie 16.

Thus, the bogie 16 is in the active configuration especially during the operating phases of the railway vehicle 10 or if a load is applied to the bogie 16 as will be explained later.

The bogie 16 comprises a chassis 20, at least one pair of wheels 22, at least one shaft 24, at least two wheel hubs 26 and at least two axle boxes 28.

The chassis 20 comprises at least one transverse beam 30 suitable for supporting the load of the car 14.

Each transverse beam 30 connects two axle boxes 28 to form an axle.

Advantageously, the frame 20 comprises at least two transverse beams 30 substantially parallel to each other.

Each pair of wheels 22 is rotatably mounted on the bogie 16 by one of the axles.

The wheels 22 are configured to run on the rails 12 and thus allow the railway vehicle 10 to move.

Each shaft 24 connects the two wheels of one of the wheel pairs 22.

Each shaft 24 extends along a substantially transverse axle axis A-A'.

Advantageously, the bogie 16 comprises two shafts 24 each extending transversely, parallel to the transverse beams 30.

The bogie 16 has a wheel hub 26 associated with each wheel 22.

Each wheel hub 26 is attached to the associated wheel 22 and shaft 24.

The associated shaft 24 is inserted into the wheel hub 26.

Advantageously, each shaft 24 is connected to the associated hub 26 by a splined connection 32. In particular, each shaft 24 comprises at least one spline mating with at least one groove in the hub 26 allowing a good coupling between the two parts and an efficient transmission of the torque from the engine of the railway vehicle to the wheels 22.

The bogie 16 comprises a axle box 28 associated with each wheel 22.

Each axle box 28 is connected to the chassis 20, for example by a primary suspension, not shown, and receives an associated hub 26.

Each axle box 28 extends along an axle box axis B-B'.

Each hub 26 is rotatably mounted within the associated axle box 28, for example by means of bearings 34. Thus, each wheel 22 is rotatable relative to the chassis 20.

Each hub 26 extends along a hub axis B-B'.

Each hub 26 is hollow and forms a solid of revolution about the hub axis B-B' into which a section of the shaft 24 fits.

Each hub axis B-B' forms a camber angle $\alpha$ with the axle axis A-A'.

The bogie 16 is configured such that when the bogie 16 is in the rest configuration (i.e. unloaded), the camber angle $\alpha$ is non-zero. This is contrary to conventional bogie assembly methods.

The camber angle $\alpha$ when the bogie 16 is at rest is predetermined at least as a function of the stiffness of the axle, mainly the transverse beam 30, and the vertical load carried by the bogie 16 in the active configuration.

As this load is variable, the camber angle $\alpha$ is determined using a predicted average load.

Thus, the axle axis A-A' and the hub axis B-B' are not aligned in the rest configuration.

A method of machining a bogie 16 in a first embodiment will now be described.

Initially, the individual parts of bogie 16 are separated from each other.

Each beam 30 extends substantially straight.

The method of machining the bogie 16 includes an initial step of prestressing at least one of the beams 30 by applying a vertical prestressing load to the chassis 20.

The prestressing load is applied, for example, by a machine exerting a vertical force towards the factory floor at the centre of the beam 30.

In particular, the prestressing load of the beam 30 is greater than an equivalent load of 5,000 kg, especially greater than an equivalent load of 8,000 kg.

Figure 2:
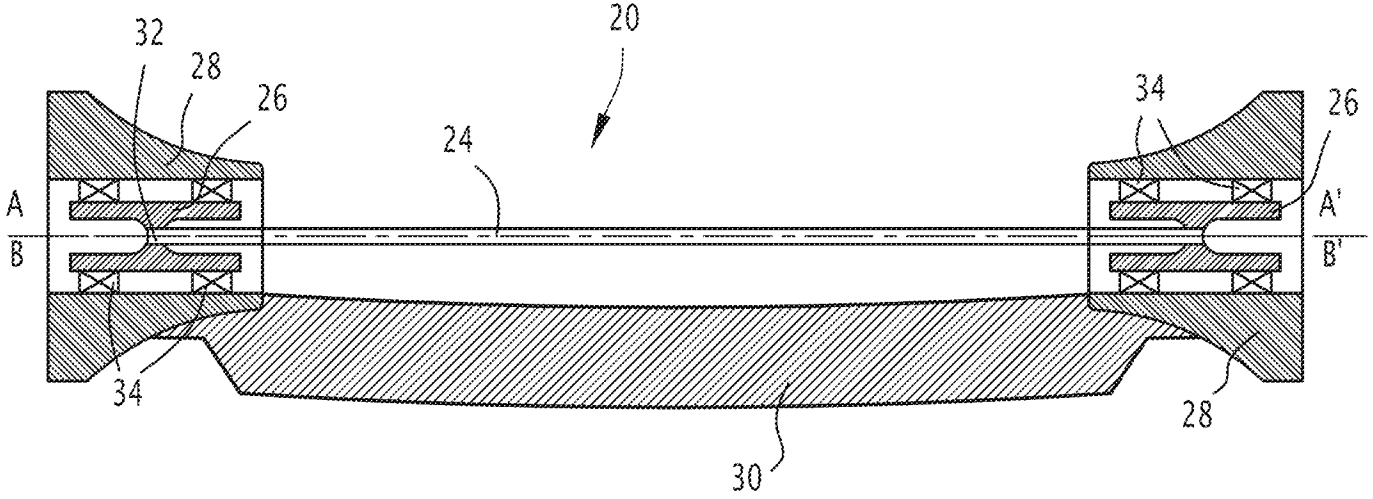
FIG. 2 is a cross-sectional schematic view of a chassis according to a first embodiment of a bogie of the vehicle of FIG. 1.

The beam 30 deforms into a concave shape, as shown in FIG. 2.

The two axle box axes are then not aligned and form a non-zero angle between them.

The method then includes a step of machining each axle box 28 so as to receive the associated hub 26 with the preload still applied.

The axle box 28 is machined so that the hub axis B-B' of said hub 26 is substantially parallel to the axle axis A-A' of the associated axle 24.

In particular, the machining of each axle box 28 is carried out in such a way that the two hub axes B-B' are substantially coaxial.

Then, still applying the prestressing load, the hubs 26 and axle 24 are inserted into the axle boxes 28. The two hubs 26 and the axle 24 are thus substantially coaxial.

Next, the prestressing load is released and the deformation of the beam 30 decreases.

The bogie 16 is now in the rest configuration.

The two hub axes B-B' then form a non-zero angle between them.

In particular, the camber angle $\alpha$ between each hub axis B-B' and the axle axis A-A' is non-zero.

The railway vehicle 10 is then assembled by placing at least one car 14 on the bogie 16.

During operation of the railway vehicle 10, when the car 14 contains passengers and/or goods, the car 14 exerts a vertical load on the bogie 16 similar to the pre-stressing load on the transverse beam 30.

The camber angle $\alpha$ is then reduced, and for example approximately zero when the operating load is substantially equal to the pre-stressing load applied during manufacture.

The hubs 26 and the shaft 24 are thus aligned and premature wear of the bogie 16 due to friction is avoided.

A method of machining a bogie 16 in a first embodiment will now be described.

Initially, the individual parts of bogie 16 are separated from each other.

The bogie 16 is initially in the rest configuration.

In contrast to the first embodiment, no prestressing load is applied to the beams 30.

The machining method then includes a step of machining each axle box 28 so as to receive the associated hub 26.

Figure 3:
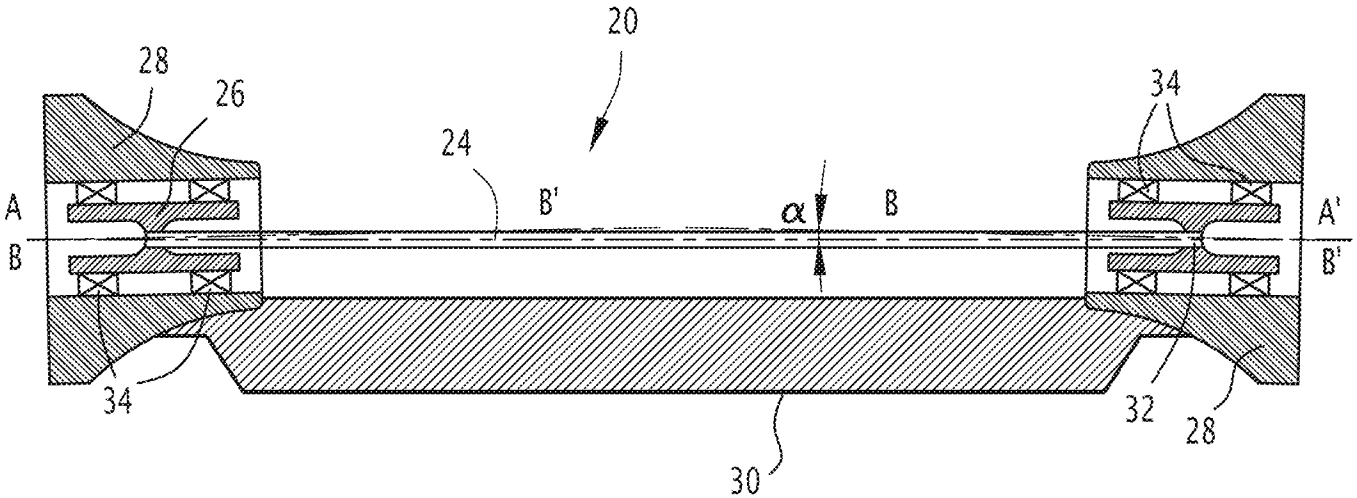
FIG. 3 is a cross-sectional schematic view of a chassis according to a second embodiment of the bogie of FIG. 1.

The machining is performed so that the hub axis B-B' of said hub 26 forms a non-zero camber angle $\alpha$ with the axle axis A-A', as shown in FIG. 3.

As can be seen in FIG. 3, the two hub axes B-B' are not parallel and form a non-zero angle with each other.

Then the hubs 26 and shaft 24 are inserted into the axle boxes 28.

The shaft 24 is inserted into each associated hub 26 despite the misalignment, and it fits, for example, due to play in the hub 26.

The railway vehicle 10 is then assembled by placing at least one car 14 on the bogie 16.

During operation of the railway vehicle 10, when the car 14 contains passengers and/or goods, the car 14 exerts a vertical load on the bogie 16 which deforms the beam 30 and tends to realign the two hub axes B-B'.

The camber angle $\alpha$ in operation is small, and in particular approximately zero.

The hubs 26 and the axle 24 are thus aligned and premature wear of the bogie 16 due to friction is avoided.

It is therefore clear that the present invention has a number of advantages.

Indeed, as explained above, the bogie 16 according to the invention allows a lower risk of premature wear due to the alignment of the hubs 26 and the axle 24 in the active configuration of the bogie 16.

This reduces the need for maintenance on the bogie 16 and extends the life of bogie 16.

Finally, both embodiments of the methods of machining according to the invention of the bogie 16 are easily implemented during the assembly of the railway vehicle 10 without lengthening the manufacturing time.

What is claimed is:

1. A bogie of a railway vehicle capable of being moved from a rest configuration to an active configuration in which the bogie supports at least one vertical load, the bogie comprising:

a chassis, at least one pair of wheels, for each pair of wheels, a shaft connecting the two wheels of said pair of wheels, each shaft extending along an axle axis, for each wheel, a wheel hub attached to the wheel and the associated shaft, said shaft being inserted into the hub, each hub extending along a hub axis, for each wheel, an axle box fixed to the chassis and receiving the associated hub, each hub being rotatable relative to the associated axle box, wherein, for each hub, the hub axis forms a non-zero camber angle with the axle axis of the associated shaft when the bogie is in the rest configuration.

2. The bogie according claim 1, wherein the camber angle when the bogie is in the rest configuration is predetermined at least as a function of the stiffness of the chassis and the vertical load supported by the bogie in the active configuration.

3. The bogie according to claim 1, wherein the chassis comprises, for each shaft, at least one transverse beam connecting the two axle boxes associated with said axle.

4. A method of machining a bogie according to claim 3, the bogie being initially in the rest configuration, the method comprising:

prestressing the transverse beam by applying a vertical load to the chassis, machining each axle box so as to receive the associated hub, the machining being carried out so that the hub axis of said hub is substantially parallel to the axle axis of the associated shaft.

5. The method of machining according to claim 4, wherein the prestressing of the transverse beam is greater than an equivalent load of 5,000 kg.

6. The method of machining according to claim 4, wherein the prestressing of the transverse beam is greater than an equivalent load of 8,000 kg.

7. The bogie according to claim 1, wherein each shaft is connected to each associated hub by a splined connection.

8. The railway vehicle comprising at least one bogie according to claim 1.

9. The railway vehicle according to claim 8, further comprising at least one car supported by the bogie, the bogie being configured to support a vertical load due to the at least one car and to passengers and/or goods carried by said car.

10. The method of machining a bogie according to claim 1, the bogie being initially in the rest configuration, the method comprising at least one step of machining each axle box so as to receive the associated hub, the machining being performed so that the hub axis of said hub forms the non-zero camber angle.

* * * * *